United States Patent [19]

Henderson et al.

[11] Patent Number: 4,571,207

[45] Date of Patent: Feb. 18, 1986

[54] EXERCISE TOY FOR DOLL

[75] Inventors: Richard E. Henderson, Costa Mesa; Mark S. Wittenberg, Anaheim, both of Calif.

[73] Assignee: Mattel, Inc., Hawthorne, Calif.

[21] Appl. No.: 688,665

[22] Filed: Jan. 3, 1985

[51] Int. Cl.[4] ..... A63H 11/00; A63H 3/00

[52] U.S. Cl. ..... 446/352; 446/268; 446/359

[58] Field of Search ..... 446/359, 358, 365, 352, 446/268, 330, 479

[56] References Cited

U.S. PATENT DOCUMENTS

| | | | |
|---|---|---|---|
| 1,008,348 | 11/1911 | Mann | 446/352 |
| 1,172,756 | 2/1916 | Bacon | 446/359 |
| 3,852,911 | 12/1974 | Sapkus et al. | 446/365 |
| 4,040,206 | 8/1977 | Kimura | 446/352 |
| 4,124,950 | 11/1978 | Becker | 46/109 |

FOREIGN PATENT DOCUMENTS

| | | | |
|---|---|---|---|
| 1430513 | 3/1976 | United Kingdom | 446/286 |

*Primary Examiner*—Mickey Yu

*Attorney, Agent, or Firm*—Ronald M. Goldman; Melvin A. Klein; Daniel F. Sullivan

[57] ABSTRACT

A simulated exercise apparatus toy having a housing with a seat portion, handlebars, rotatable simulated pedals and a simulated control panel with a window. A manually operated crank is provided with gear members within the housing rotating the pedals and simultaneously rotating a drum member with the indicia thereon appearing within the window of the simulated control panel to simulate an exercise function, such as respiration, or the like. Internal to the housing, one of the pedals is provided with first and second concentric bevel gears, one for engaging the bevel gear operated by the crank, and the second engaging a bevel gear operating the drum member.

12 Claims, 5 Drawing Figures

FIG. 3
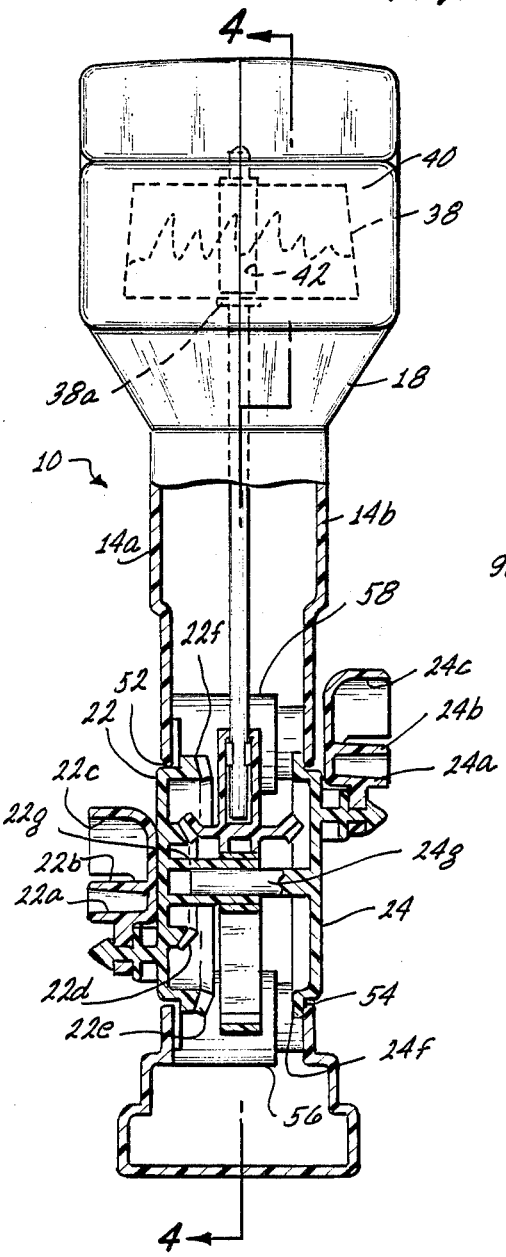
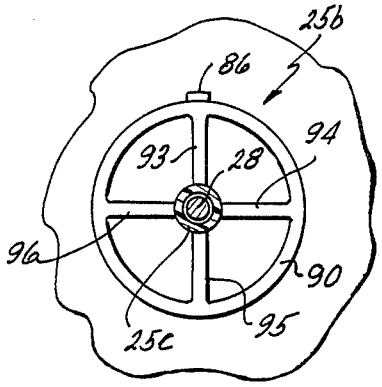
FIG. 5

EXERCISE TOY FOR DOLL

BACKGROUND OF THE INVENTION

The background of the invention will be discussed in two parts:

1. Field of the Invention

This invention relates to toys, and more particularly to a toy exercise apparatus for a doll with articulated limbs.

2. Description of the Prior Art

Numerous devices have been made for use with dolls and the like to simulate a play environment. Toy vehicles or the like for use with dolls appear to be very common, with the doll being removable.

Such a toy is shown and described in British Pat. No. 1,430,513, entitled "Animated Figure Toy", published Mar. 31, 1976. This patent shows and describes a figure toy having movable limbs, with at least one of the limbs being provided with a pile fabric having loops for engaging a pile fabric having hooks on a movable part of a toy vehicle, such as a wagon or tricycle. Connection of the hook fabric to the loop fabric simulates movement of the limbs of the doll upon movement of the toy vehicle. In one embodiment pile fabric connectors are affixed to the hands and feet of the figure toy for interconnection to mating fabric patches on the handlebars and pedals of a tricycle, thus making the doll or figure toy removable. Another animated toy is shown and described in U.S. Pat. No. 4,124,950, entitled "Action Toy", issued Nov. 14, 1978 to Becker. In this device, a tricycle is provided with shoe-shaped pedals, a toy figure is secured to the seat thereof, and elastomeric members interconnect the pedals and the figure to simulate legs which flex upon movement of the tricycle.

It is an object of the present invention to provide a new and improved animated toy using a figure toy and an apparatus in connection therewith.

It is another object of the present invention to provide a new and improved exercise toy for use with a doll having movable or articulated leg members.

SUMMARY OF THE INVENTION

The foregoing and other objects are accomplished by providing a simulated exercise apparatus having a housing with a seat portion, handlebars, rotatable simulated pedals and a simulated screen. A manually operated crank is provided with gear members within the housing rotating the pedals and simultaneously rotating a drum member with the indicia thereon appearing within the window of the simulated screen to simulate an exercise function, such as respiration, or the like. Internal to the housing, one of the pedals is provided with first and second concentric bevel gears, one for engaging the bevel gear operated by the crank, and the second engaging a bevel gear operating the drum member.

Other objects, features and advantages of the invention will become apparent from a reading of the specification, when taken in conjunction with the drawings, in which like reference numerals refer to like elements in the several views.

BRIEF DESCRIPTION OF THE DRAWINGS

FIG. 3 is a cross-sectional view of the exercise toy of FIG. 2 as viewed generally along line 3—3 thereof;

FIG. 5 is a side view of the coupling of the crank assembly as viewed generally along line 5—5 of FIG. 4.

DESCRIPTION OF THE PREFERRED EMBODIMENT

Figure 1:
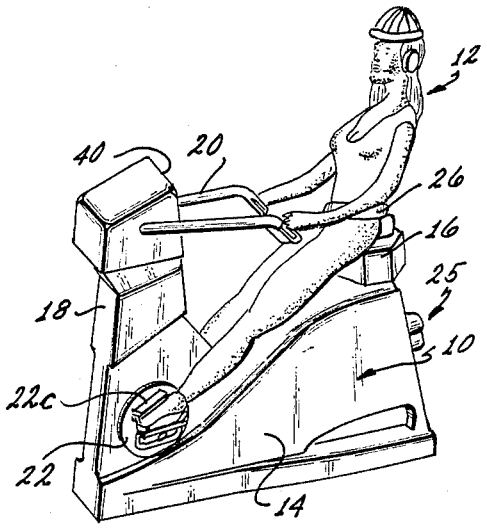
FIG. 1 is a perspective view of the exercise toy for a doll according to the present invention.

Referring now to the drawings, and particularly to FIG. 1, there is shown a toy exercise apparatus, generally designated 10 with an action figure or doll 12 seated thereon. The apparatus 10 is configured in the form of a bicycle exercise machine of the futuristic type which may be found in health spas or the like, and includes a generally closed housing 14 with a seat portion 16 and an upwardly extending front portion 18 supporting handle bars 20 adjacent the upper end thereof, the handle bars 20 extending into proximate relation to the hands of the doll 12.

At the lower end of the front portion 18, the apparatus 10 is provided with first and second pedal devices 22 and 24 having foot retaining means for engaging the feet of the doll 12. The foot retaining means, as better illustrated in FIG. 2 include a sole plate **22*a* which is generally planar with a heel stop 22*b* at the rear thereof, the heel stop being angularly disposed relative to the sole plate. An upper foot plate 22*c* extends out from the pedal device 22 in spaced angular relation to the sole plate 22*a* for engaging the upper portion of the foot with the sole of the foot resting on the sole plate 22*a***.

For use with this apparatus 10, the doll 12 is the type referred to as an action figure, that is the doll 12 has movable or articulated limbs which may be posed or positioned to simulate human positions. As will be hereinafter described the doll 12 is positioned in a seating position on the seat 16 of the apparatus 10 with the feet positioned in each of the pedal devices 22 and 24, and captively retained therein by the sole plates **22*a*, 24*a*, the heel plates 22*b*, 24*b*, and the upper foot plates 22*c*, 24*c*. To assist in maintaining the doll 12 in the seated position a seat belt 26 may optionally be provided for encircling the waist of the doll 12 and the back of the seat 16**.

A manually rotatable crank 25 is provided extending from the rear surface of the housing 14, and upon rotation thereof, the pedal devices 22 and 24 rotate, causing movement of the limbs generally attached thereto to thus simulate the "bicycling" of the doll 12. To further provide realism for the use of such exercise devices, the upper portion 18 of the apparatus 10 is provided with a simulated control panel surface and "screen" in viewing relation to the doll 12 with the "screen" providing a "moving view" of some function related to the exercise, such as an indicia of heart rate, respiration or the like. In the alternative, with some such bicycle exercise devices, the "screen" may provide some indication of distance travelled, type of terrain on which the traveling is being done, or the like. In any event, the details will now be described.

Figure 2:
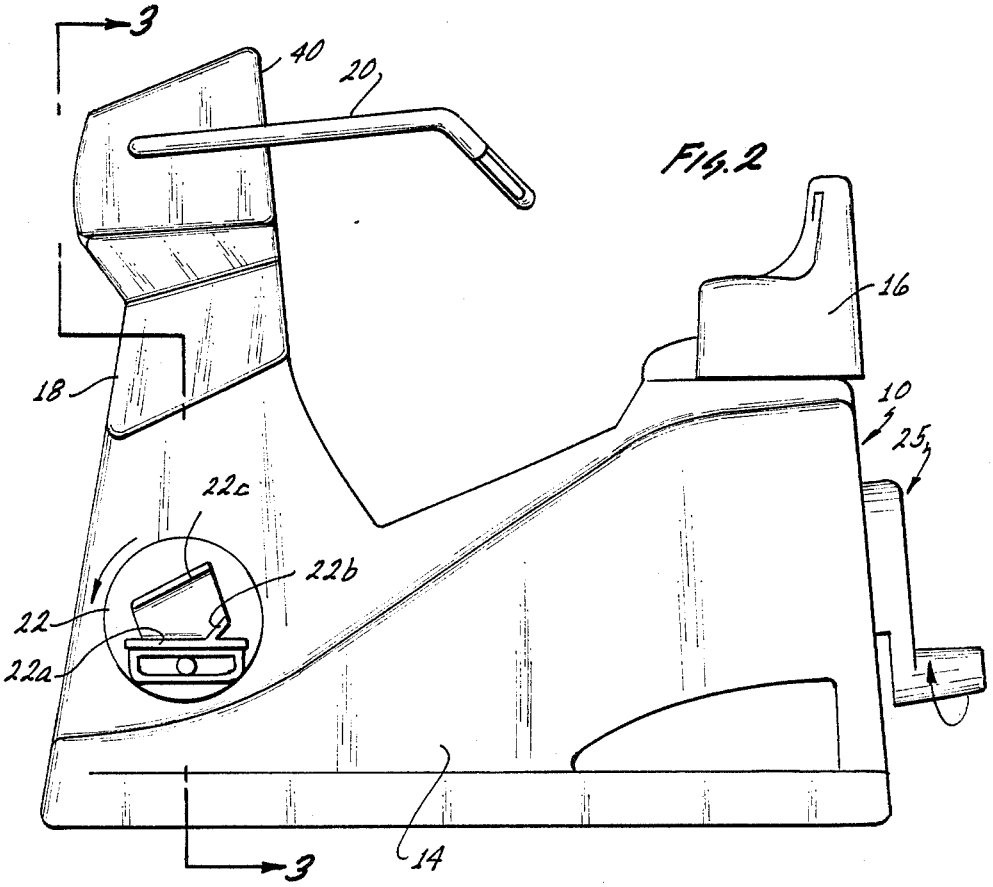
FIG. 2 is a side elevational view of the exercise toy of FIG. 1.
Figure 4:
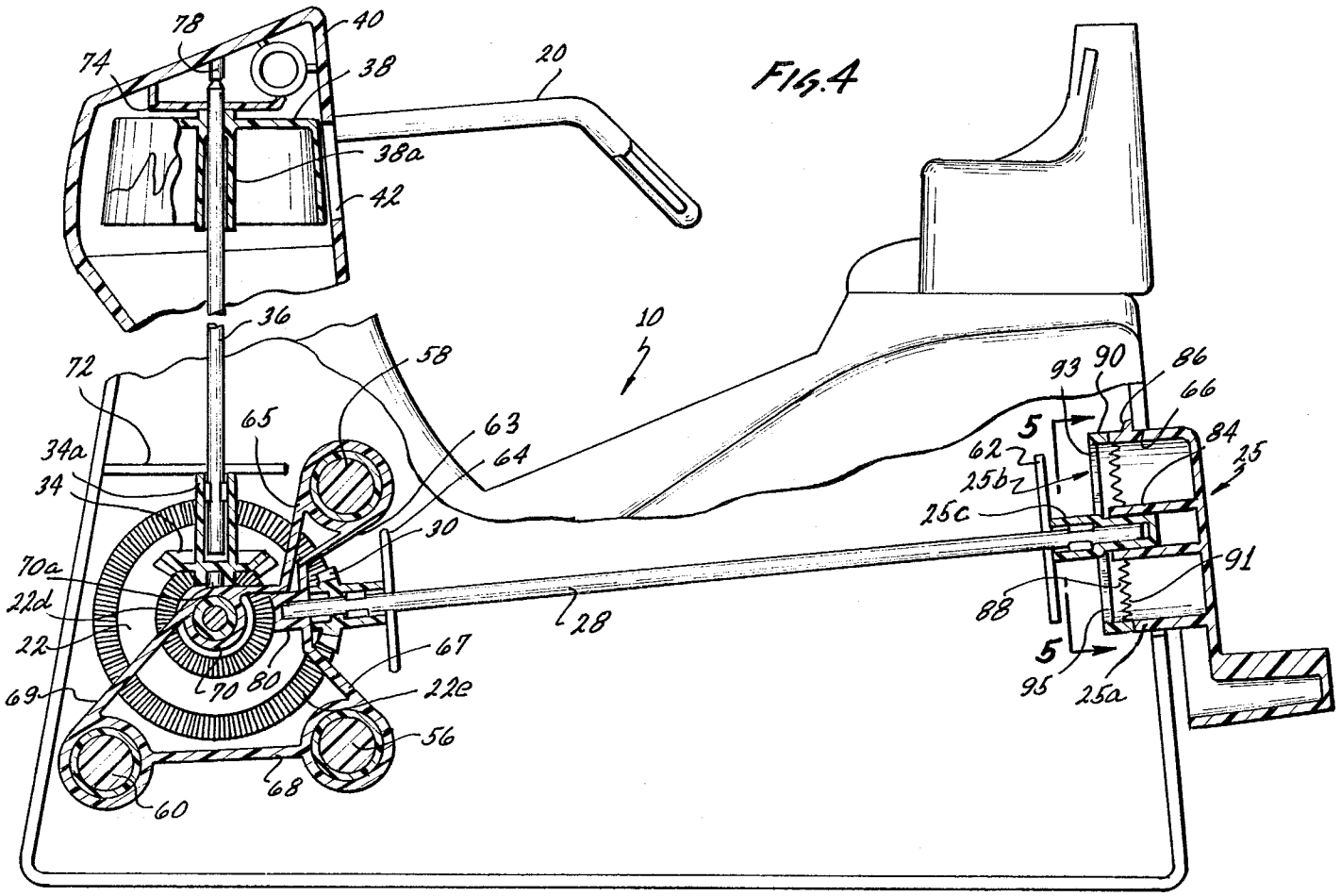
FIG. 4 is a cross-sectional view of the exercise toy of FIGS. 2 and 3 as viewed generally along line 4—4 of FIG. 3.

Referring now to FIGS. 2 through 4, the housing 14 is an enclosure of generally hollow configuration, the exterior of which is modernistically configured to simulate an exercise machine for "bicycling". The housing is preferably made of two half housing shells **14*a* and 14*b***, each of which includes certain internally extending projections and the like for securing the two halves together and for providing journals and bushings for retaining the gear members and rotatable members therein.

Prior to a detailed discussion, a brief description of the various moving parts along with the interconnections and operation thereof will enable a ready understanding of the apparatus 10. Briefly the crank 25, through a flexible coupling which will be described later, drives an axle 28 which has connected at the end thereof a bevel drive gear 30. One of the pedal devices 22 has configured on the interior thereof first and second annular concentric bevel gear portions 22*d* and 22*e*, with the bevel drive gear 30 meshing with the outer bevel gear portion 22*e*. Pedal devices 22 and 24 are coupled together, as will be described hereinafter, for effecting corresponding rotation in the same direction when driven. The inner bevel gear portion 22*d* of the pedal device 22 meshingly engages a second bevel gear 34 coupled to a shaft 36 which extends generally transversely to the first shaft or axle 28, the terminal end of shaft 36 being inside the uppermost portion of the front portion 18 of the housing 14, where, affixed thereto, is a drum member 38 having a peripheral surface with indicia thereon.

The upper "screen" portion of the front portion 18 of the housing 14 is configured as a generally planar "control panel" surface 40 in viewing position relative to the doll 12, with a viewing window 42 therein for enabling viewing of the indicia on the periphery of the drum member 38. In operation, as the crank 25 is rotated, the shaft 28 is rotated along with the bevel drive gear 30. The outer annular gear portion 22*e* of pedal device 22 engaged thereby is rotated to effect rotation of the coupled pedal devices 22 and 24, thereby moving the feet of the doll 12 engaged in the foot retaining means on the opposite or outer surfaces of the pedal devices 22 and 24. With rotation of the pedal devices 22 and 24, the bevel gear 34 is then rotated due to the meshing engagement with the inner bevel gear portion 22*d* to thereby rotate the shaft 36 along with the drum member 38 at the upper end thereof, thereby presenting different "moving" portions of the indicia on the periphery thereof for viewing through the "screen" or window 42 of the control panel surface 40.

The interior details will now be discussed in detail with reference to FIGS. 3 and 4. Each of the pedal devices 22 and 24 is essentially a disc-shaped member with integrally formed foot retaining means (sole plates 22*a*, 24*a*, heel plates 22*b*, 24*b* and upper foot plates 22*c*, 24*c*) formed on one side thereof and the concentric annular bevel gear portions 22*d* and 22*e* formed on the opposite or interior surface of one of the pedal devices, such as pedal devices 22.

As best illustrated in FIG. 3, the housing portions 14*a* and 14*b* are formed with enlarged circular apertures 52 and 54 having approximately the same diameter as the disc-shaped portions of the pedal devices 22 and 24, each of which has an enlarged flange portion 22*f* and 24*f* for abuttingly engaging the inner surface of the housing portions 14*a* and 14*b* about the periphery of apertures 52 and 54 for sliding engagement therewith during rotation of the pedal devices 22 and 24, respectively. The disc-shaped portion of the pedal devices 22 and 24 extend through the apertures 52 and 54, respectively.

Each of the pedal devices 22 and 24 is provided with a centrally disposed inwardly extending axle portion 22*g* and 24*g* of different diameters, portion 22*g* having an opening therein for receiving portion 24*g* in telescoping relation therewith, with the parts secured together, such as with adhesive, with the foot retaining means of the pedal devices 22 and 24 being offset 180 degrees relative to one another, similar to the two pedals of a bicycle. Similarly, the housing portions 14*a* and 14*b* are provided with intercoupling bosses for securing the two halves together, such as bosses 56, 58 and 60 (see also FIG. 4). Although not shown, others will be provided at appropriate points on the interior of the housing portions 14*a* and 14*b* to effect a structurally sound interconnection during assembly.

Also integrally formed on the interior of the housing portions 14*a* and 14*b* are those journals or bearings required for supporting the gear members and shaft assemblies.

Referring now primarily to FIG. 4, shaft supporting members are provided on the interior of the housing 14, with these members taking the form of parallel spaced webs 62 and 64 having circular apertures therethrough for rotatably receiving shaft 28 along an axis, this axis coinciding with the center of an enlarged circular aperture 66 formed in the rear surface of housing 14 which receives therein the crank member 25.

For supporting the pedal assembly, webs 65,67 and 69 interconnect the three bosses 56, 58 and 60 to form a center bushing or journal 70 through which the axle portion 22*g* of the pedal device 22 extends in rotatable relation. Additional spaced generally parallel webs 72 and 74 are formed on the interior of the housing 14 within the front portion 18 thereof, with apertures therein for rotatably supporting the shaft 36.

Each of the shafts 28 and 36 has operative components connected thereto. The shaft 36 has connected to one end thereof the bevel gear 34 in secure relation with the other end having received thereon the drum member 38, this member 38 having an axle portion 38*a* with a tubular aperture therethrough for snug fitting coaction with the shaft 36 for concurrent rotation therewith. Within the interior of the housing 14, at the location where the shaft 36 passes through the aperture of the web 74, the housing is provided with a stop member 78 in general alignment with the axis of the shaft 36 to limit end play during rotation and maintain the periphery of the drum member 38 in general alignment with the window 42 of the control panel surface 40. This stop simultaneously maintains the meshing engagement of the bevel gear 34 with the bevel gear portion 22*d* of the pedal device 22. The bevel gear 34 is provided with a centrally disposed axle portion 34*a* with an opening therein for receiving the end of the shaft 36 with the end of the axle portion 34*a* being in proximate relation to the surface of web 72. The journal 70 for the pedal assembly is provided with a flattened surface 70*a* in alignment with and in proximity to the flattened nose end of the bevel gear 34 to act as a second stop member for the shaft 36.

Similarly, integrally formed at the juncture of webs 63 and 67, is a journal 80 formed to receive one end of the drive shaft 28 with the bevel drive gear 30 having an aperture therethrough for passage of the shaft 28 therethrough, the dimensions of the bevel drive gear 30 in the direction of the shaft 28 being slightly less than the distance between the opening of the journal 80 and the adjacent web 64 which assists in supporting the shaft 28.

As illustrated in FIGS. 4 and 5, the crank 25 is formed in two parts, these being an outer crank housing 25*a* and an inner flexible coupling crank member 25*b*. As will be described, the parts are dimensioned, arranged and configured so that the inner member 25*b* is coupled for concurrent rotation with the shaft 28, and the outer crank member 25*a* is coupled for rotation relative to the inner crank member 25*b*. To this end, the inner crank member 25*b* is provided with a centrally disposed cap portion 25*c* which is received on the end of the shaft 28. The outer crank member 25*a* is provided with a centrally disposed inwardly extending hub portion 84 having an opening therein of slightly larger diameter than the cap portion 25*c* with the hub 84 being positioned over the closed end of the cap portion 25*c*.

The outer crank member 25*a* is generally cup-shaped with an enlarged circular flange portion 86 of slightly larger diameter than the skirt portion of the member 25*a* which passes through the aperture 66 in the housing 14. On the interior, the skirt portion of crank member 25*a* terminates with a serrated or sawtooth edge 88, which engages a matingly configured aligned edge 91 of an outer ring portion 90 of the inner crank member 25*b*. As best shown in FIG. 5, the outer ring portion 90 is interconnected with the cap portion 25*c* by means of four flexible radially extending equiangularly disposed spokes 93–96, inclusive. In order to minimize damage to the gear members as well as to take up any shock as a result of cranking too fast, or resistance to rotation of the parts due to inability of the figure toy 10 to move rapidly, upon any resistance of the mechanical parts, the spokes 93–96 flex under pressure thereby separating the teeth 91 of the cylindrical outer portion 90 from the teeth 88 of the skirt portion of the outer crank member 25*a*.

In accordance with the present invention, as previously described, in operation, upon rotation of the crank 25, with the figure toy 12 positioned on and secured to the seat 16 with the feet in the pedal devices 22 and 24, the action simulated is that of a human exercisisng on a modernistic toy exercise apparatus 10, with the control panel providing a moving indicia of respiration, heart beat or the like in graphical form through the window 42 of the control panel 38. The apparatus 10 is compact with few moving parts to provide an economical toy device for use with an action figure toy.

While there has been shown and described a preferred embodiment, it is to be understood that various other adaptations and modifications may be made within the spirit and scope of the invention.

We claim:

1. In a toy exercise apparatus, the combination comprising:

(a) a housing having formed thereon a surface simulating a control panel with window means therein and seat means for retaining a figure toy thereon;

(b) pedal means rotatably mounted to said housing and having means for retaining the feet of the figure toy;

(c) manually rotatable crank means on said housing;

(d) indicia means movably mounted within said housing for viewing through said window means; and (e) means within said housing responsive to rotation of said crank means for (i) rotating said pedal means and (ii) moving said indicia means for positioning different portions thereof for viewing through said window means, whereby rotation of said crank means moves the legs of the figure toy to simulate bicycling with the movement of said indicia means simulating display of a function related to the exercise.

2. The combination according to claim 1 wherein said indicia means includes a drum member having the periphery thereof with indicia thereon in proximate relation to said window means.

3. The combination according to claim 2 wherein said window means is an opening in said control panel surface.

4. The combination according to claim 3 wherein said pedal means includes first and second disc-shaped members having plate means for releasably retaining the feet of the figure toy.

5. The combination according to claim 1 wherein said means responsive to rotation of said crank means includes gear means.

6. The combination according to claim 5 wherein said gear means includes bevel gear members.

7. The combination according to claim 3 wherein said pedal means includes first and second disc-shaped members coupled for concurrent rotation, said means responsive to rotation of said crank means includes gear members and at least one of said disk-shaped members is provided with a gear portion.

8. The combination according to claim 7 wherein said gear portion is an annular bevel gear portion and said crank means actuates a bevel drive gear member in meshing relation with said annular bevel gear portion.

9. The combination according to claim 8 wherein said disc-shaped member includes a second annular bevel gear portion for coacting with other gear means interoperatively coupled to said drum member for effecting rotation of said drum member.

10. In a toy exercise apparatus, the combination comprising:

(a) a generally hollow housing having a surface simulating a control panel with window means therein and means for retaining a figure toy thereon;

(b) first and second pedal devices having intercoupled disc-shaped portions rotatably supported by said housing, each of said disc-shaped portions having formed on one surface thereof means for releasably retaining a foot of the figure toy;

(c) manually operable crank means rotatably supported by said housing;

(d) a drive gear member coupled for rotation in response to rotation of said crank means;

(e) indicia means movably mounted within said housing for viewing through said window means;

(f) another gear member operatively coupled to said indicia means; and (g) gear means formed on the opposite surface of at least one of said disc-shaped portions for meshingly engaging said drive gear member and said another gear member for effecting rotation of said pedal means in synchronism with movement of said indicia means upon rotation of said crank means for positioning different portions of said indicia means for viewing through said window means, whereby rotation of said crank means moves the legs of the figure toy to simulate bicycling with the movement of said indicia means simulating display of a function related to the exercise.

11. The combination according to claim 10 wherein said indicia means includes a drum member having indicia on the periphery thereof.

12. The combination according to claim 11 wherein said apparatus further includes handlebar means attached to said housing and terminating at a position in proximate relation to the hands of a figure toy thereon.

* * * * *